United States Patent [19]

Finnegan

[11] Patent Number: 4,466,639

[45] Date of Patent: Aug. 21, 1984

[54] LOOSE LEAF HOLDER

[76] Inventor: Charles L. Finnegan, 4210 N. 52nd St., Omaha, Douglas County, Nebr. 68104

[21] Appl. No.: 359,634

[22] Filed: Mar. 18, 1982

Related U.S. Application Data

[63] Continuation of Ser. No. 141,249, Apr. 17, 1980, abandoned.

[51] Int. Cl.[3] ..... B42D 3/12; B42F 11/04

[52] U.S. Cl. ..... 281/45; 402/503

[58] Field of Search ..... 281/DIG. 1, 38, 40, 281/41, 45; 24/73 MS; 402/48, 60, 79, 80 R, 503

[56] References Cited

FOREIGN PATENT DOCUMENTS 673582 11/1963 Canada ..... 402/503

631466 11/1949 United Kingdom ..... 402/503

*Primary Examiner*—Paul A. Bell
*Assistant Examiner*—John S. Brown
*Attorney, Agent, or Firm*—Henderson & Sturm

[57] ABSTRACT

A holder for loose leaf sheets of material, such as paper, having a base for the support of the sheets, a magnetic body located at an edge of the top side of the base, and a means for securing the sheets in a temporary manner in the holder. The means for securement utilizes magnetically-responsive material. A back panel with means for lining up the sheets and for a hinged cover is also provided.

5 Claims, 7 Drawing Figures

LOOSE LEAF HOLDER

This application is a continuation of application Ser. No. 141,249, filed Apr. 17, 1980, now abandoned.

BACKGROUND OF THE INVENTION

1. Field of the Invention

The present invention relates to holders for loose leaf sheets of material, and more particularly to those which provide a convenient means for insertion and removal of the sheets and a firm base upon which to write or draw.

2. Description of the Prior Art

The most common loose leaf folders or binders for paper are of the type having hinged covers, and a back panel to join the two. Located between the cover and base along the inside of the back panel are metal or plastic rings constructed and joined in a manner which allows the user to "open" the rings simultaneously into a U-shaped position. A leg of each of the now U-shaped rings is passed through a pre-punched hole in a loose sheet of paper. Once the paper is retained upon the legs, the opened rings are closed shut by the user and the paper remains in the holder until the user reverses the above-described process.

Although in general, these devices have performed satisfactorily there are some problems which include painful injury to the user's hand when a ring catches the skin of the hand as the ring snaps shut and inconvenience to the user when the rings prohibit the user from writing to the edge of the paper due to the user's writing-hand knuckles hitting against the rings as the edge of the paper is reached. Also, as the amount of paper to be contained increases, the retaining rings must be made substantially larger to adequately hold the paper. The increased size of the rings requires that the holder become cumbersome in weight and bulky in appearance. Furthermore, if the paper happens to slip off either one or all of the rings, it can cause quite an inconvenience to the user to place it back upon the rings when the folder is full and the loosened sheet is not the top sheet.

Another conventional holder which has some pitfalls is that utilizing a clip board retaining device. Such a device, though, is generally incapable of holding more than a thin layer of sheets without the lower sheets slipping free. Also, the sheets of the top layers of the stack often times get creased by the clamping force of the clip.

The present invention utilizing a magnetic body and magnetically-responsive material can provide a solution to the above-described problems.

SUMMARY OF THE INVENTION

According to the present invention a holder comprised of a supportive base and at least one magnetic body attached to the top side of the base either along the base's upper or left edge are provided. In operation, the user brings a sheet of material having a magnetically-responsive point or edge portion into contact with the magnetic body of the holder. The resulting magnetic force field retains the sheet in the contacting position upon the base until the user applies sufficient force to overcome the magnetic retaining force thereby releasing the sheet from the holder. A protective cover attached to the magnetic body or a back panel member and means for even stacking of the sheets are also provided.

An object of the present invention is to provide a simple yet more dependable loose leaf folder for temporarily holding sheets of paper in an orderly fashion.

A further object of the present invention is to provide a holder wherein loose sheets of material, such as paper, can be secured in a temporary fashion to a magnetic body.

Another object of the invention is to provide a quicker, simpler, securer, more convenient means for temporarily securing sheets of material in a particular order or sequence and then adding sheets, removing sheets, or changing the order of the sheets.

A further object of the instant invention is to provide a holder retaining a relatively large number of sheets whose retaining mechanism does not tear nor otherwise damage the sheets.

Another object of the instant invention is to provide a loose leaf holder of the preceding object which also has a cover to protect the secured sheets from damage while they are being retained in the holder.

These and other objects, advantages and novel features of the invention will become apparent from the following detailed description of the invention when considered in conjunction with the accompanying drawings.

DESCRIPTION OF THE PREFERRED EMBODIMENTS

Figure 1:
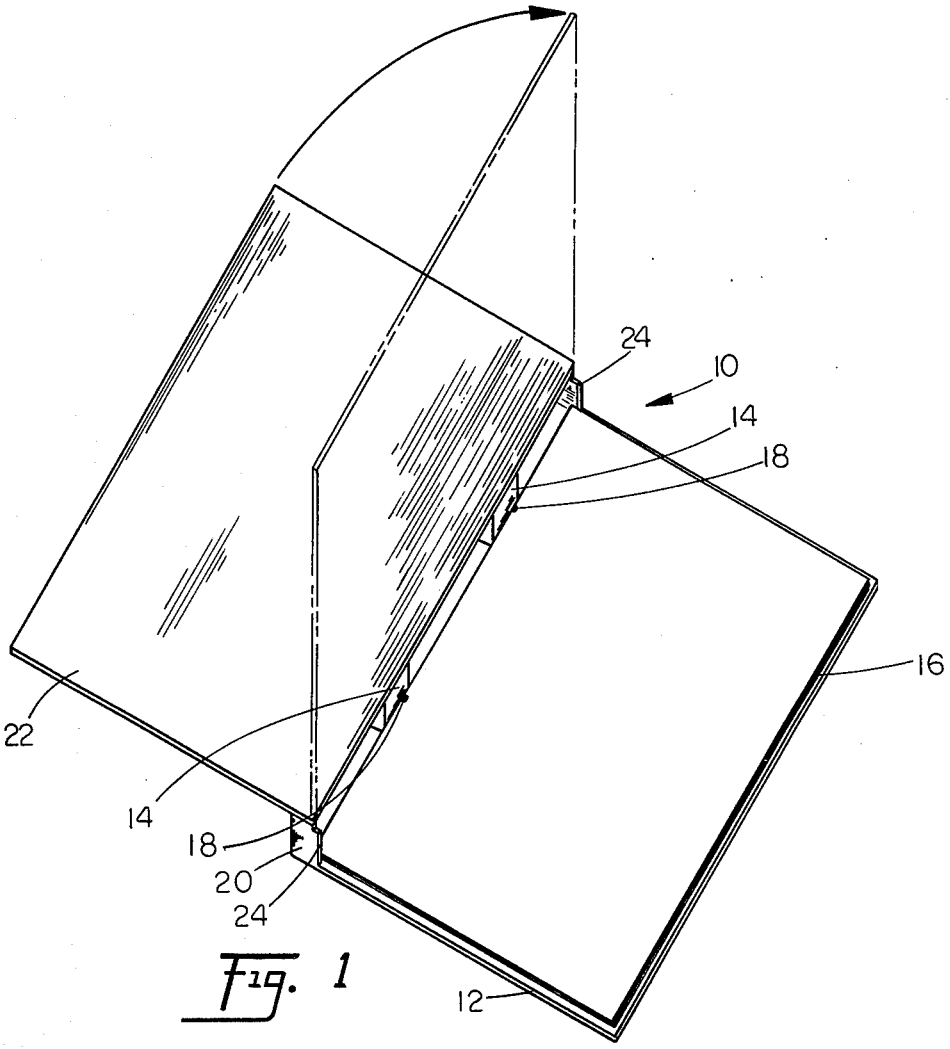
FIG. 1 is a perspective view of a preferred embodiment of a loose leaf holder shown in open position and the direction of cover closure.

Referring now to the drawings wherein like reference numerals designate identical or corresponding parts throughout the several views, and more particularly to FIG. 1 wherein the preferred embodiment improved loose leaf holder is referenced generally by the numeral 10, the holder includes a relatively rigid base 12 with at least one magnetic body 14 mounted on top of and near an edge of the base 12. The loose sheets of material 16, such as paper, lie upon the base. Secured to an edge of the paper are magnetically-responsive means 18, such as small steel tabs, or a magnetically-responsive coating. The magnetically-responsive means 18 are distanced along the paper's edge such that they will contact the magnetic bodies 14 when the paper is placed on the base 12. The positioning of the magnetically-responsive elements upon the edges of the sheets will be discussed more fully hereinafter.

The holder includes a back panel 20, attached to the edge of base 12 near which the magnetic bodies 14 are mounted, and a cover 22 hingedly affixed upon the top edge of the back panel 20. The cover 22 could be made sturdy enough to allow the user to use it as a writing surface. FIG. 1 further illustrates by use of an arrow the direction of movement the cover 22 will travel from its open position to a closed position. In this embodiment the back panel 20 is extended a short distance along both the top and bottom edges of the base 12 thereby forming corners 24 at both ends of the back panel 20 and base 12. The back panel corners 24 will serve as guide means for the user as loose sheets are inserted into the holder 10 and can further serve as a means for maintaining the ordered position of the loose sheets as they are retained in the holder.

Figure 2:
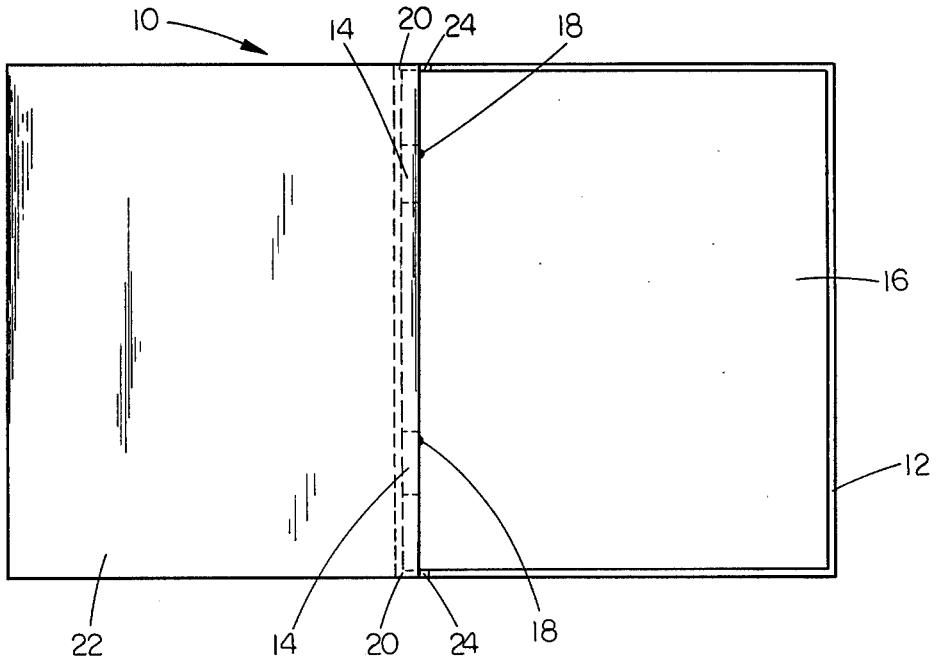
FIG. 2 is a top view of the preferred embodiment of the invention shown in open position.

Referring now to FIG. 2, the holder 10 is shown lying completely open. The magnetic bodies 14 and back panel 20 are shown by dashed lines as those elements would be hidden in this view by the opened cover. The sheets of paper 16 are shown positioned between the protruding back panel corners 24 and held within the holder by the magnetic force attraction between the magnetic bodies 14 and the magnetically-responsive means 18.

Figure 4:
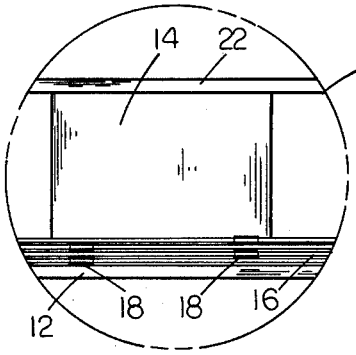
FIG. 4 is an exaggerated partial front end view of the holder showing layered sheets with magnetically responsive tabs in alternating and staggered positions.
Figure 3:
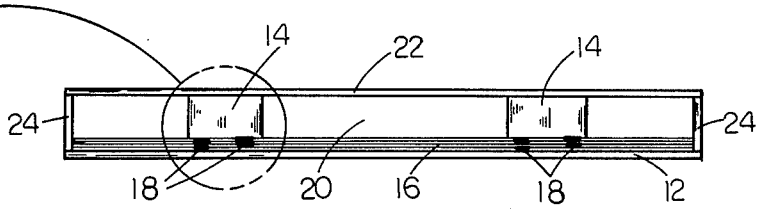
FIG. 3 is a front end view of the preferred embodiment illustrating the loose leaf sheets of paper retained against the magnetic bodies atop the base of the holder.
Figure 5:
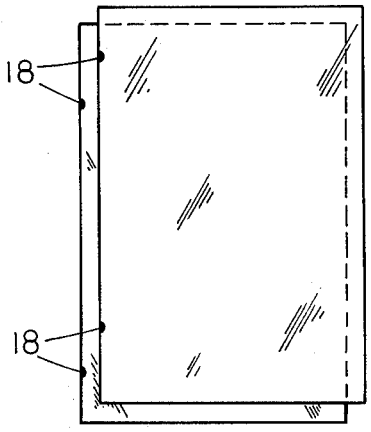
FIG. 5 is a top view of two sheets illustrating the resulting staggering of the magnetically responsive elements when alternate sheets are flipped over with respect to the preceding sheet.
Figure 6:
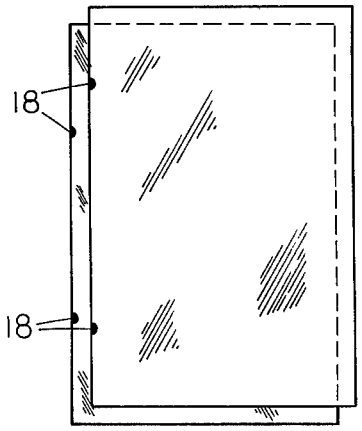
FIG. 6 is a top view of two sheets illustrating an alternate method for staggering the magnetically responsive elements along the edge of the sheets.

Referring now to FIG. 3, the positional relationship between the sheets 16 and the magnetic bodies 14 of the holder 10 is illustrated. As viewed from the front of the holder in a closed position, the sheets 16 are layered or stacked one upon another, and the magnetically-responsive means 18 are spaced along the sheet edges so that they not only contact the magnetic bodies 14 but do so in an alternating staggered fashion which is more clearly shown by the exaggerated partial front end view of FIG. 4. The staggering of the magnetically-responsive means 18 serves the purpose of reducing the vertical space which would otherwise be required to accomodate them. FIGS. 5 and 6 teach two possible methods for placing the magnetically-responsive means 18 along the sheet edges so as to achieve their desired alternate staggering. In FIG. 5, the magnetically-responsive means 18 are off-centered, and staggering is accomplished by alternately reversing the face of each sheet. In FIG. 6 staggering is accomplished by centering the magnetically-responsive means 18 on each sheet but in a different spaced distance on each sheet, all within the force field of the magnetic bodies 14.

Figure 7:
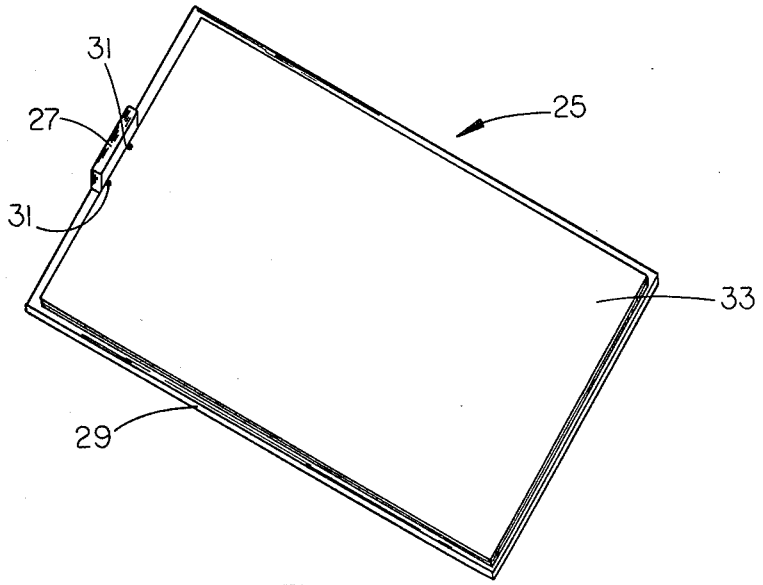
FIG. 7 is a perspective view of a second embodiment of the invention.

A second embodiment of the improved holder is shown in FIG. 7 and referenced generally by the numeral 25. A clip board type arrangement results when the magnetic body 27 is placed along a top edge of the base 29 rather than the side edge of the base as shown in the preferred embodiment of FIG. 1. The magnetically-responsive means 31 are again equi-distanced upon an edge of each loose sheet 33 so as to contact the magnetic body 27 thus creating the magnetic force attraction which retains the sheet upon the holder's base 29.

The cooperation of the holder's elements yields the desired result of maintaining temporarily but dependably the loose sheets within the holder. To operate the preferred embodiment depicted in FIG. 1, the user opens the holder 10 to reveal the magnetic bodies 14. A sheet of paper is then inserted in a manner such that the sheet is between the back panel corners 24. The sheet edge having the magnetically-responsive means affixed along it becomes the inside edge contacting the magnetic bodies 14. The contact must be sufficient to allow a magnetic force field attraction to be created between the magnetic bodies 14 and the sheet's magnetically-responsive means 18. The resulting attraction retains the sheet within the holder until the steps are reversed and the user thereby releases a sheet from the holder.

Obviously, numerous modifications and variations of the present invention are possible in light of the above description and the accompanying drawings. It is therefore to be understood that within the scope of the appended claims the invention may be practiced otherwise than as specifically described therein.

I claim:

1. In combination, an improved holder for sheets of paper comprising:

(a) a rectangular substantially rigid base for supporting a stack of rectangular paper shaped similar to and sized slightly smaller than said base, so as to provide a firm surface upon which to write or draw on any sheet of paper supported in whole or in part by said base;

(b) a back panel disposed substantially normal to said base and being non-hingeably affixed along one edge of said base;

(c) two rectangular planar back panel corners, each said back panel corner being disposed and affixed normal to both said base and to said back panel;

(d) at least one magnetic body mounted proximal to said back panel between said two back panel corners; and (e) a stack of paper with magnetically-responsive means permanently secured to each sheet of paper for operable magnetic interaction with said at least one magnetic body, such that each sheet of paper will become aligned during insertion by said back panel corners, and will be removably held in place by said at least one magnetic body, temporarily securing it along a single uninterrupted straight edge thereof to said at least one magnetic body, and continually maintained in an ordered position by said back panel corners when so secured.

2. The holder of claim 1 wherein said magnetically-responsive means is a small steel member pressed onto the edge of the paper.

3. The holder of claim 1 wherein said magnetically-responsive means comprises a coating secured to an edge of each sheet.

4. The holder of claim 1, 2 or 3 further comprising a cover equal in length to said back panel and hingedly attached to said back panel.

5. The holder of claims 1, 2 or 3 wherein the magnetically-responsive means is further characterized as being located in staggered positions with respect to the top and bottom edges of alternate sheets of paper within the stack.

* * * * *